M7219 XR 4,271,908

United States Patent [19]

Robinson, Jr. et al.

[11] 4,271,908

[45] Jun. 9, 1981

[54] TRACKED CABLE GUIDE ASSEMBLY AND METHOD FOR STORING CONDUCTOR CABLE INSIDE A DRILL PIPE

[75] Inventors: Leon H. Robinson, Jr.; Adelbert Barry; Jerry M. Speers, all of Houston, Tex.

[73] Assignee: Exxon Production Research Company, Houston, Tex.

[21] Appl. No.: 116,517

[22] Filed: Jan. 29, 1980

[51] Int. Cl.[3] ..... E21B 17/00; E21B 47/12

[52] U.S. Cl. ..... 166/315; 166/65 R; 174/47; 175/40; 175/320; 242/47.5

[58] Field of Search ..... 175/40, 50, 57, 65, 175/85, 104, 320, 315; 166/65 R, 315; 174/47, 69, 70 R; 242/47.5, 147 R, 149; 19/12 R

[56] References Cited

U.S. PATENT DOCUMENTS

| | | | |
|---|---|---|---|
| 1,493,936 | 5/1924 | Hale | 242/47.5 X |
| 1,864,891 | 6/1932 | Coberly et al. | 242/47.5 |
| 2,026,327 | 12/1935 | Sparling | 242/47.5 X |
| 3,282,356 | 11/1966 | Pawlson et al. | 175/315 X |
| 3,825,078 | 7/1974 | Heilhecker et al. | 175/57 |
| 3,825,079 | 7/1974 | Heilhecker | 175/57 |
| 3,913,688 | 10/1975 | Heilhecker et al. | 175/65 X |
| 3,918,537 | 11/1975 | Heilhecker | 175/65 X |
| 3,957,118 | 5/1976 | Barry et al. | 166/65 R X |
| 4,098,342 | 7/1978 | Robinson et al. | 175/57 X |

*Primary Examiner*—Stephen J. Novosad

*Attorney, Agent, or Firm*—Robert B. Martin; John C. Hammer

[57] ABSTRACT

An improved apparatus to store an insulated electrical conductor cable in a overlapped configuration within a drill pipe includes a track attached to the drill pipe to guide a lower cable guide so that the overlapped portions of conductor cable will not snarl or twist during rotary drilling operations. To insure against entanglement, further restriction of rotation may be gained by additionally tracking the lower cable guide on a tensioned portion of the conductor cable which extends from a subsurface instrument package upwardly to an upper cable guide. A method for installing this improved apparatus is also disclosed.

7 Claims, 4 Drawing Figures

TRACKED CABLE GUIDE ASSEMBLY AND METHOD FOR STORING CONDUCTOR CABLE INSIDE A DRILL PIPE

BACKGROUND OF THE INVENTION

1. Field of the Invention

The tracked cable guide assembly of this invention improves the capability for storage of electrical conductor cable in a drill pipe. Twisting is prevented or reduced in the overlapped portion of cable which is looped between upper and lower cable guides. This invention also simplifies the placement of the storage apparatus within the drill pipe.

2. Description of the Prior Art

Telemetry is a major focus for research in the drilling of oil, gas, or similar boreholes into subterranean formations. Enhanced transmission of data concerning downhole conditions could improve drilling safety and efficiency. Sending coded electrical impulses to disclose subsurface conditions is one method of telemetry. Measuring conditions and transmitting data while drilling, however, is complicated. To develop a reliable electrical transmission means has been a major goal. In conventional rotary drilling, thirty (30)-foot sections of drill pipe are added to the drill string as drilling proceeds. To maintain an electrical circuit to the surface, additional conductor cable must be available when pipe is added. Sections of cable may be added at the surface or additional cable may be stored within the drill pipe and threaded through each additional pipe section. This invention relates to an improved apparatus to store excess conductor cable within the drill pipe.

Earlier telemetry operations required that an instrument package be lowered into the drill pipe or wellbore when measurements were desired. Drilling had to stop to collect downhole data. It could not proceed until the instrument package was removed from the well. Thus, telemetry was a slow process which greatly disrupted the drilling operation.

To reduce the disruption caused by the earliest telemetry system, an electrical conductor was incorporated into the drill pipe. A circuit was formed through the pipe with special connections at each joint. U.S. Pat. Nos. 3,518,608 and 3,518,609. The incorporated conductor system was undesirable for at least three reasons. One, junctions at each joint greatly increased the circuit resistance. Greater power was required to transmit electrical impulses. Two, the junctions often short-circuited because insulating them from the drilling mud was difficult. Three, drill pipe had to be modified significantly. This modification either greatly increased the cost of telemetry, or induced operators not to use this system.

Another suggested improvement over the earliest telemetry system was to run a conductor cable inside the drill pipe from a downhole instrument package to the surface and to add additional sections of cable at the surface when additional drill pipe was connected to the drill string. In U.S. Pat. No. 2,748,358, sections of cable somewhat longer than the section of pipe added were connected to the existing conductor line. As with the modified drill pipe, however, this system proved undesirable in many circumstances. Again, the multitude of connections required increased power to transmit electrical signals. The cable connections tended to erode under the abrasive action of drilling mud. Erosion led to system failure. The excess length of cable could snarl and tangle with itself during the drilling operations, either impeding withdrawal of the cable or leading to telemetry system failure.

In U.S. Pat. No. 3,807,502, an attempt was made to reduce the twisting and snarling problem of storing excess conductor cable within the drill pipe. At the beginning of a drill bit run, a continuous length of cable was suspended from the surface to a subsurface instrument. Additional lengths of conductor cable were added for each section of pipe added during the bit run. The improved system provided a clamp to remove slack between the instrument and the surface. This system, however, was still inefficient. One, it still required a number of cable sections and connections. Two, it consumed large amounts of cable because a new length of continuous cable had to be payed out at the beginning of each bit run.

A second system to reduce twisting and snarling was disclosed in U.S. Pat. Nos. 3,825,079 and 3,918,537. Instead of a clamp to remove slack in the conductor cable within the drill pipe, these patents disclosed an apparatus to store the excess conductor cable in an overlapped configuration. A rigid track extended between an upper and a lower cable guide to permit axial motion of the lower cable guide, but to prevent relative angular movement. Typically about sixty (60) feet of excess cable could be stored in this overlapped configuration. The system contemplated adding sections of conductor cable with each, additional pipe section.

Further improvements were developed to store a continuous segment of conductor cable within the drill pipe. These improvements eliminated the multitude of connections. In one system, additional lengths of cable were withdrawn from a cable storage reservoir as pipe sections were added. U.S. Pat. Nos. 3,825,078 and 3,913,688 typically, cable was stored in an overlapped configuration between upper and lower cable guides.

In U.S. Pat. No. 4,098,342, use of a constriction in the pipe joints limited rotation of the lower cable guide. A long weight was added to the lower guide, and checks were added to each pipe joint to limit the twisting of this weight. Two design criteria of this system may limit its suitability in some circumstances. The checks have to be added at each joint and be aligned so that twisting will be prevented. The weight has to be long enough (typically about thirty-six (36) feet) so that it will continually contact at least one of the checks.

Excess conductor cable may be wrapped around a spool which is then suspended in the drill pipe. U.S. Pat. No. 4,153,120. To add pipe, additional sections of cable may be manually unwound from the spool after withdrawing the spool from the drill pipe. By necessity, this system requires slacked cable within the pipe, equal in length at least to the length of the spool plus the desired pipe length. This excess cable would tend to tangle during drilling operations.

A further development of the overlapped cable system disclosed a means to tension the segment of cable extending from the subsurface location up to the upper cable guide. U.S. Pat. No. 3,957,118. Suspending the weighted lower cable guide on a looped portion of the cable eliminated slack in the overlapped segments of the conductor cable, but did not sufficiently tension this segment of cable. The gripping means allowed a tension to be placed on this segment and maintained thereon.

This invention continues the development of the overlapped conductor cable system. It presents further improvements.

SUMMARY OF THE INVENTION

The apparatus of this invention stores a continuous, electrical conductor cable between a subsurface instrument package and the surface. Excess cable shaped in an overlapped configuration is stored to prevent or to impede snarling or twisting. The conductor cable extends upwardly from a subsurface location to an upper cable guide. Preferably this segment of conductor cable is anchored at the subsurface location to an instrument package useful for well drilling telemetry. Furthermore, this segment is preferably held in tension by means for gripping which are associated with the upper cable guide. The conductor cable extends from the upper cable guide down to a lower cable guide which is suspended on a looped portion of the cable. From the lower cable guide, the conductor cable extends up to the surface. The lower cable guide is free to move axially within the drill string as conductor cable is payed in or payed out. The upper cable guide is mounted in the drill pipe. The cable guides define an overlapped portion of cable where excess cable may be stored.

A novel feature of this invention is the use of a flexible, elongated member, preferably a cable, which is attached to the inside of the drill pipe between points substantially at the upper cable guide and substantially at the subsurface location. Upon tensioning, the elongated member serves as a guide track for the axial motion of the lower cable guide. One or more connector arms attach the lower cable guide to the substantially vertical, elongated member which extends along the length of the drill pipe. These connector arms allow axial motion, but they impede or prevent rotation of the lower cable guide relative to the upper cable guide and to the drill string. To control the rotation further, the lower cable guide may preferably be connected to the tensioned portion of the conductor cable which extends from the subsurface location up to the upper cable guide.

The tracked cable guide assembly of this invention is an improvement over prior art systems because it is more efficient and more reliable. Installation of the assembly is simplified because flexible members are preferably used instead of rigid members. Preferably a cable is fastened to the inside of the drill pipe to form a substantially vertical track which becomes rigid upon tensioning. Thus, the cumbersome handling problems of using initially rigid members are reduced.

The tracked cable guide assembly offers greater improvements than merely installational efficiency. Entanglement of the stored cable is reduced so that drilling operations are not often disrupted. Telemetry is facilitated. The system allows nearly instantaneous communication of downhole conditions to the surface throughout all phases of drilling. The system eliminates the need to align constrictions at each section of pipe—only the location of a single pin is important to installing the apparatus of this invention. Furthermore, the system of this invention allows for easier removal of that apparatus placed within the drill pipe which would impede emergency operations. The upper and lower cable guides are preferably releasably attached to the drill pipe. The upper guide is releasably attached to a spider mounting; the lower guide is releasably connected to the track which is attached to the inside of the drill pipe. Thus, by remote action at the surface, the drill pipe may be quickly cleared of all constrictions which will interfere with passage of tools down the well. Preferably, all that need be done is to apply a force to the conductor cable at the surface to extract it and the two cable guides from the drill pipe.

DESCRIPTION OF THE PREFERRED EMBODIMENTS

1. Introduction

This invention is an improved means for storing electrical conductor cable inside a drill string. An overlapped portion of cable is looped around upper and lower cable guides positioned in a drill string to store cable between surface and subsurface locations. The lower cable guide is weighted to maintain tension in those segments of conductor cable that loop on the two cable guides. The lower cable guide is movable in an axial direction within the drill string to allow storage of various lengths of cable. Its axial motion is guided by one or more tracks established inside the drill string.

This invention may be used in both conventional rotary drilling and in specialized drilling. Rotary drilling applications are preferred. A typical example of specialized drilling is use of a turbo-drill and a positive displacement hydraulic motor to drill a slightly deviated or directional wellbore. The customary apparatus of conventional rotary drilling and specialized drilling is discussed in U.S. Pat. No. 4,098,342 (Robinson et al.). This patent also discusses the process of drilling a wellbore. The information disclosed in this patent is incorporated by reference into this specification.

2. The Parts of the Apparatus

Figure 1:
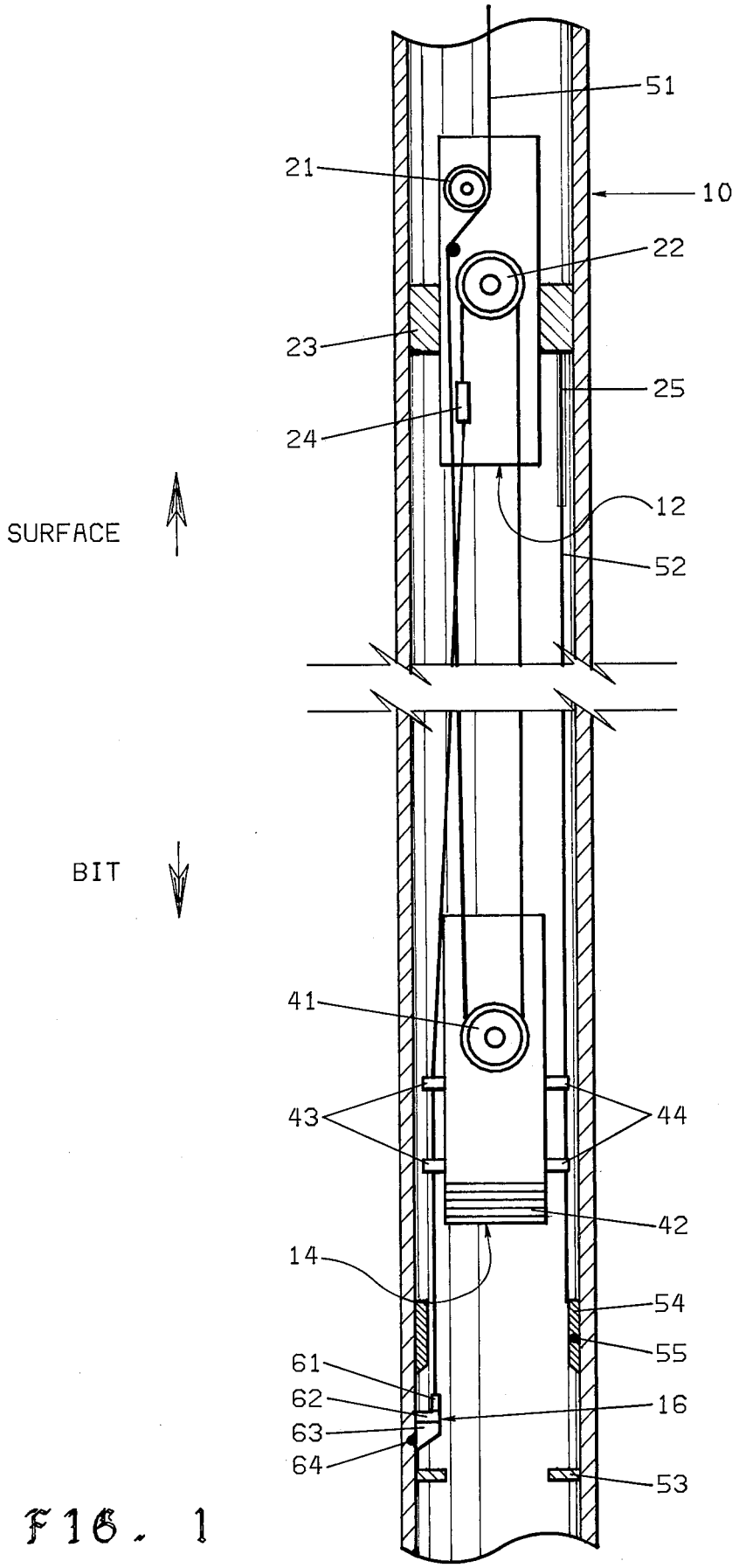
FIG. 1 is a schematic illustration of the preferred embodiment of this invention. It shows an upper and a lower cable guide disposed in a drill string to store electrical conductor cable. The axial motion of the lower cable guide is tracked on two tracks. One track constitutes that segment of the conductor cable which extends between the upper cable guide and a subsurface location. The other track constitutes an elongated member attached to the inside of the drill string.

FIG. 1 schematically shows the three (3) major components of the apparatus. Inside a drill string 10, an elongated member 52 guides a lower cable guide 14 between an upper cable guide 12 and a point substantially at a subsurface location 16 to store electrical conductor cable in an overlapped configuration.

The upper cable guide 12 preferably comprises:

(1) a centralizer 21;

(2) an upper sheave 22;

(3) a means 23 for mounting the upper cable guide in the drill string 10;

(4) a means 24 for gripping the conductor cable; and (5) a connection 25 for the upper end of the elongated member 52 which forms a track inside the drill string 10.

The lower cable guide 14 preferably comprises:

(1) a lower sheave 41;

(2) one or more cable weights 42;

(3) one or more connector arms 43 to join the lower cable guide 14 to that portion of the conductor cable which extends between the upper cable guide and the subsurface location; and (4) one or more connector arms 44 to join the lower cable guide 14 to the elongated member.

At a subsurface location 16, an electrical connector 61 joins the conductor cable 51 to an instrument package which preferably comprises:

(1) a receiver package 62 to receive commands from the surface, to activate downhole measuring devices, to store and to multiplex signals and to transmit coded, electrical signals back to the surface representative of the measured phenomenon;

(2) a measurement package 63 to record downhole conditions in response to commands; and (3) transducers 64 to measure downhole conditions in terms of equivalent electrical impulses.

Typical phenomena of interest include temperature, pressure, inclination, weight-on-bit, bit wear, radioactivity, and the like.

Also, illustrated in FIG. 1 are incidental apparatus. The elongated member 52 which forms a track inside the drill pipe 10 is preferably releasably connected to the drill pipe 10 by a lower connection 54 which preferably attaches to the drill string 10 on a pin 55 and groove (not shown). Furthermore, a stop guide 53 is preferably placed in the drill string 10 at a point above the bit to check the downward motion of equipment associated with the conductor cable storage system. If equipment were to fall in the drill pipe, it would be stopped by the stop guide 53 before it were to fall into the bit.

Throughout this specification the terms "drill pipe" and "drill string" will be used interchangeably to mean that portion of tubular goods which extends into the wellbore when one drills into a subterranean formation. Conventional distinctions between the terms are irrelevant for purposes of the discussion in this specification.

3. The Operation of the Apparatus

Because this invention comprises a number of individual elements, this application will sequentially discuss each element and its relationship of each to the whole. First, the track guide will be discussed. Second, the cable storage assembly will be discussed. Third, a summary of the operation of the entire apparatus will be discussed.

A. The Track Guide

Figure 3:
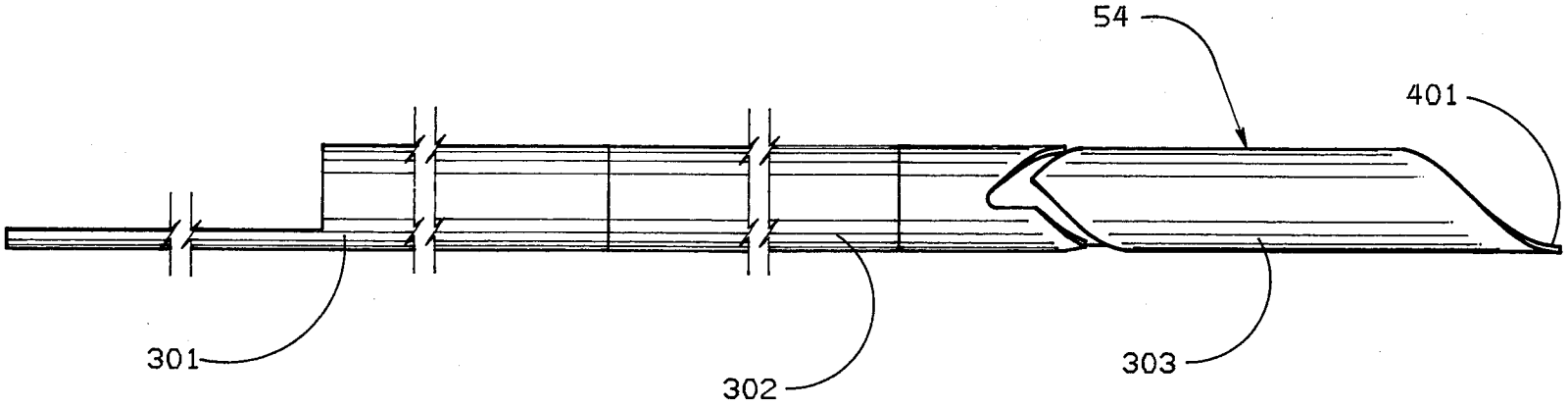
FIG. 3 is a drawing of the lower connection of the elongated member which forms the track along the inside of the drill string.

Preferably a flexible, elongated member 52 extends from a point substantially at the lower end of the upper cable guide 12 downwardly to a point substantially at, although somewhat slightly above, a subsurface location 16. The elongated member is substantially vertical. By the term "substantially vertical," it is meant that the elongated member is essentially parallel to the centerline of the drill string 10 in the plane which would contain both the centerline and the elongated member if they were truly parallel. "Substantially vertical" is used in this application to describe this spatial relationship; it should not be used to mean vertical in a gravitational frame of reference. The substantially vertical, elongated member 52 preferably is releasably fastened to the drill string 10. Once fastened at its lower end, preferably the member is tensioned. At its upper end, a connection 25 is preferably fastened to the spider mounting 23 for the upper cable guide 12. Preferably, the connection 25 is a steel set-plate to press against the cable. At its lower end, a lower connection 54 preferably seats on a pin 55 in the drill string 10. As shown in FIG. 3, the connection 54 preferably comprises three (3) segments. The upper segment 301 is designed to be the connection for the elongated member 52. Preferably, this upper segment 301 is a cut-away portion of steel tubing to which is soldered a cable fastener (not shown) similar to that used for the upper end of the elongated member 52. The tubing is preferably cut-away to allow easier passage of tools, such as an electrical connector 61, through the lower connection 54 for the elongated member 52. Typically the clearance will be low. The cut-away portion gives slightly greater leeway.

The second segment 302 of the lower connection 54 preferably comprises a section of steel tubing threaded to mate respectively with the upper and lower segments 301 and 303. This segment eases machining of the working ends of the connection 54. Design modifiations are more readily handled with the three-fold device.

Figure 4:
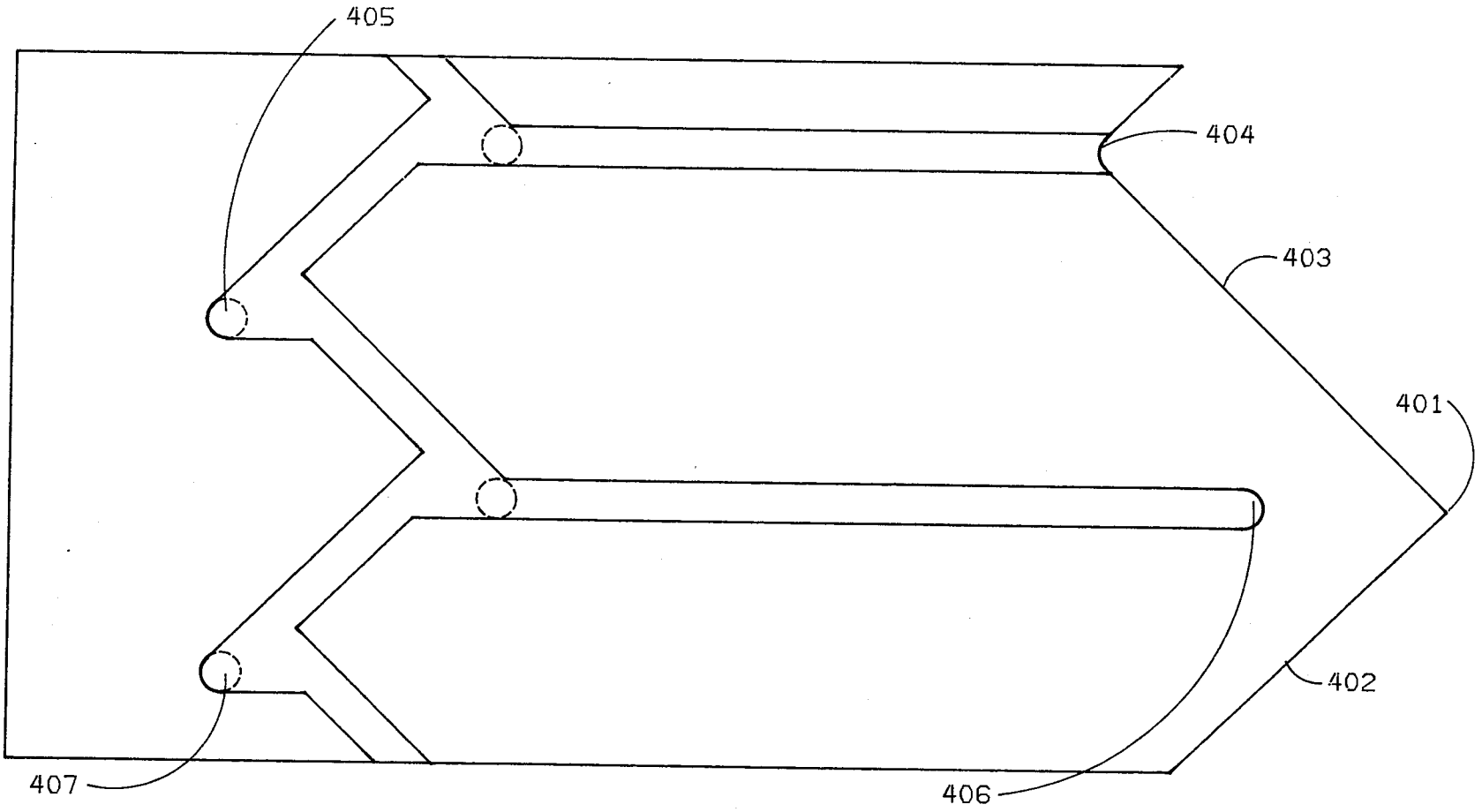
FIG. 4 is a drawing of the grooved surface on the lowest portion of the connection shown in FIG. 3. This groove allows remote attachment and detachment of the connection.

The lower segment 303 preferably is a steel tubing with a tapered point 401. Along its outer surface, the lower segment has a groove shaped in the pattern described in FIG. 4. The tapered point 401 or surface 402 or 403 contact a pin 55 on the drill string 10. The connection 54 is rotated as the pin slides upon the surface of the taper. The pin enters the groove system when the taper is complete at 404. Further lowering of the connection 54 ensues until lowering is impeded by the end of the groove 405. Tensioning the elongated member 52 causes the connection 54 to rise and to rotate as the groove is followed into the long tongue portion 406. With the connection 54 seated in this position, the elongated member 52, preferably a steel cable usually of 9.5 mm (0.375 in.) diameter, is tensioned to a pull of approximately 227 kg (500 lbs.) and is fastened at its upper end.

The lower connection may be released from its pin seat by releasing the tension in the elongated member 52. The lowering of the connection 54 will cause the pin 55 to move out of the tongue 406. The connection 54 will rotate along the groove to another lowering stop 407. Tensioning the elongated member 52 will cause the connection 54 to rotate so that the pin 55 will ultimately disengage the groove at the point where it entered 404. In such a fashion, the connection 54 may be connected and disconnected remotely.

B. The Cable Storage System

Figure 2:
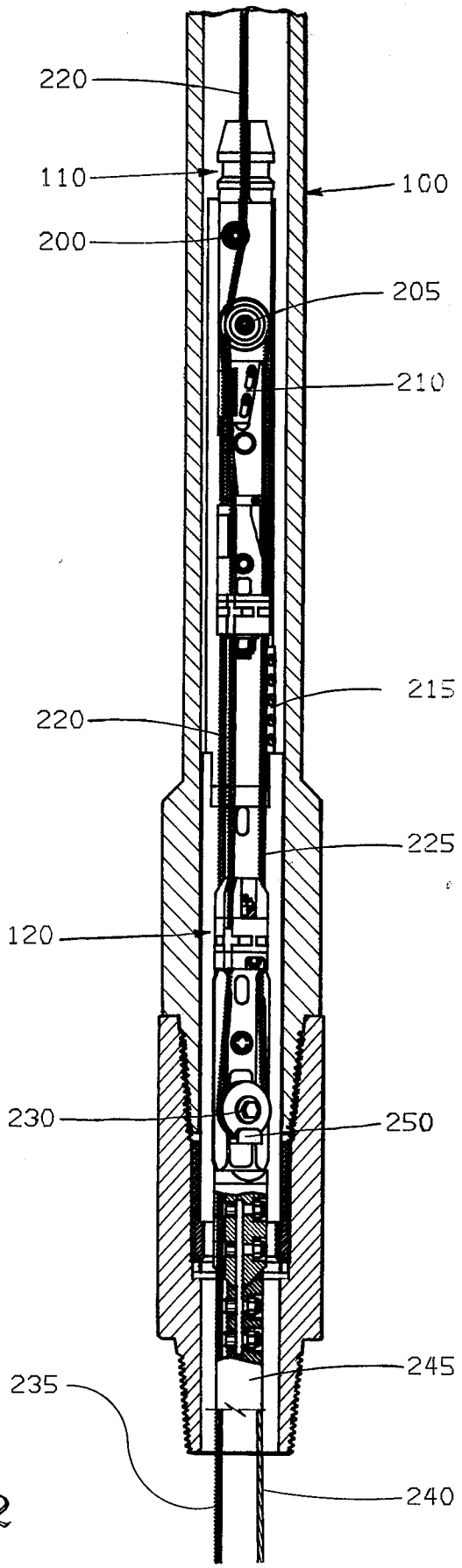
FIG. 2 is a detailed, design drawing showing the particulars of the preferred embodiment of the upper and lower cable guides.

In FIG. 2, the upper cable guide 110 and lower cable guide 120 preferred in this invention are depicted in a drill pipe 100. The insulated, electrical conductor cable extends from the subsurface location (not shown) up to and around the upper cable guide 110 in a first segment 235. Preferably this first segment of cable follows a groove formed in the cable weights 245 and the lower cable guide 120. In one embodiment of this invention, one or more connector arms (not shown) may be used to hold the cable in this groove. The connector arms preferably are flaps of rubber or some other elastomeric material which clip on buttons on the lower cable guide 120 and the cable weights 245 to form loops which enclose the cable. Connector arms of this nature impede or prevent rotation of the cable weights 245, but they permit axial movement of the lower cable guide 120 as conductor cable is payed in or out.

Preferably the first segment of the conductor cable 235 is maintained in tension. To accomplish this tensioning, means for gripping the cable 210 are mounted on the upper cable guide 110. These means are described in U.S. Pat. No. 3,957,118 (Barry et al.), which is incorporated by reference in this specification. The first segment of cable 235 is preferably connected at its lower end to an instrument package which preferably is fastened to the drill pipe 100. In this circumstance, an electrical connector 61 may be releasably attached by remote action to the instrument package. Means for tensioning the first segment of cable 235 (such as a winch) may be maintained at the surface. When the electrical connector 61 is attached to the instrument package, the means for tensioning stress the cable preferably to about 454 kg (1000 lbs.). The means for gripping 210 maintain this tension within the first segment 235.

The conductor cable passes around an upper sheave 205, which is mounted on the upper cable guide 110. In a second segment 225, the cable extends from the upper cable guide 110 down to and around the lower cable guide 120. Mounted on the lower cable guide 120, a lower sheave 230 and a sheave guard 250 keep the cable in order. The lower cable guide 120 is suspended on a loop in the conductor cable between the second segment 225 and a third segment 220. Slack is removed in these two segments, 220 and 225, by adding cable weights 245 to the lower end of the lower cable guide 120. The third segment 220 extends from the lower cable guide 120 up to the surface. Preferably, it passes through a centralizer 200 mounted on the upper cable guide 110 as it passes upwardly in the drill string.

Preferably the upper cable guide 110 is releasably mounted in the drill pipe 100. A spider preferably is shaped as a cut-away piece of tubing and is fastened to the drill pipe 110 to serve as a means for mounting. Grooves in the tubing are designed to accept retractable pins on the unshown side of the upper cable guide 110. The pins retract upon removal from the grooves. Withdrawing the cable above the upper cable guide 110 moves the lower cable guide 120 upward to reduce the length of stored cable. When the upper cable guide 110 and the lower cable guide 120 contact (as shown in FIG. 2), the minimum length of cable is stored in the well. Further withdrawal of the cable 220 will tend to raise both the upper and the lower cable guides, 110 and 120 respectively. The upper cable guide 110 will extract from the spider mounting. The entire storage apparatus can be removed then from within the drill string. The elongated member will be left attached to the inside of the drill pipe.

Associated with the spider mounting, a set plate 215 forms the cable fastener for the upper end of the elongated member 240. Preferably a cable extends upwardly from the releasable lower connection (not shown), and passes through the set plate 215. Screws may be tightened to fasten the cable between the spider mounting and a metal plate. Preferably, the cable is pretensioned to about 227 kg (500 lbs.) tension before the set plate 215 is screwed down.

The lower cable guide 120 and the cable weights 245 are preferbly grooved to accept the elongated member 240 as a track guide for the axial movement of the lower cable guide 120 as cable is payed in or out from the surface. One or more connector arms (not shown) for the elongated member 240 preferably are connected to the lower cable guide 120 and cable weights 245. These arms preferably comprise elastomeric fasteners which button on the lower cable guide 120 and on the cable weights 245. These connector arms impede or prevent rotation of the lower cable guide 120, but they permit axial movement of the lower cable guide 120. Rotation of the lower cable guide 120 relative to the upper cable guide 110 or to the drill pipe 100 may be further limited by guiding the axial movement of the lower cable guide 120 on both the first segment of cable 235 and on the elongated member 240. Twisting and snarling may be substantially prevented by tracking on both of these guides. Some rotation of the lower cable guide 120 relative to the upper cable guide 110 is allowable without creating serious entanglement problems. Rotation of less than about 30° of arc has been found to be tolerable, although it is much preferred to limit rotation as much as possible. Therefore, tracking on both the first segment of cable 235 and the elongated member is preferred.

To prevent excessive corrosion to the insulated conductor cable, especially around the upper sheave 205 and the lower sheave 230, covers (not shown) should be attached to the upper and lower cable guides to eliminate drilling mud flow from these elements.

C. Operation of the System

The lower cable guide moves axially upward and downward in the drill pipe as cable is payed in or payed out. Typically thirty (30)-foot segments will be withdrawn from the overlapped configuration as drilling proceeds. Thus, the lower cable guide will rise approximately fifteen (15) feet. Should the storage capacity be exhausted, more cable may be stored by connecting the upper end of cable to a new lead and paying out cable from the surface. The lower cable guide will lower within the drill string to store this new length. The resistance to signal transmission will be increased only by one, additional connection over that resistance of the desired length of cable.

To operate the system, the drill pipe is suspended in the well. The pipe should be long enough to store the desired length of cable between the lower pin and the surface. The lower connection for the elongated member is lowered into the drill pipe. It is fastened to the pin. A tension is placed in the elongated member. It is fastened to the upper end on the spider mounting to form a substantially vertical, track guide.

An electrical connector preferably is lowered through the lower connection to join with an instrument package at a subsurface location. The electrical connector preferably is releasably connected to the package, but it is anchored sufficiently that a tension may be placed in a first segment of cable which extends from the subsurface location up to and around the upper cable guide.

The upper cable guide is releasably mounted in the drill pipe by way of the spider mounting. The upper cable guide preferably has a means for gripping the cable to maintain a tension in the first segment of cable, which extends downwardly to the instrument package. The conductor cable is looped around upper and lower sheaves, and the lower cable guide is allowed to descend into the drill pipe as cable is payed out. Preferably the lower cable guide tracks on both the first segment of cable and the elongated member. The lower cable guide should be releasably joined to the elongated member so that the electrical connector cable, and the upper and lower cable guides may be removed from the drill pipe by exerting an upward pull on the conductor cable. The lower cable guide is lowered to store the desired amount of cable for a bit run. Typically about 1000 to 1500 feet (305–458 m) of cable may be stored in an overlapped configuration by lowering the lower cable guide.

Based upon the description contained in this specification, those skilled in the art will be capable of substituting parts while maintaining the features which distinguish this apparatus from the prior art systems. The description provided is not meant to restrict the invention except as is necessary by an interpretation of the prior art and by the spirit of the appended claims.

We claim:

1. A method to store an electrical conductor in a drill pipe which comprises the steps of:

(a) attaching an elongated member along the inside of the drill pipe;

(b) extending the electrical conductor cable from a subsurface location up to and around an upper cable guide, down to and around a lower cable guide, and up to the surface;

(c) mounting the upper cable guide in the drill pipe;

(d) tensioning the portion of cable which extends from the subsurface location to the upper cable guide and maintaining the portion of the cable in tension; and (e) paying out cable from the surface so that the lower cable guide lowers in the drill pipe to store excess conductor cable in an overlapped configuration, the axial motion of the lower cable guide being tracked on the elongated member and the tensioned portion of the cable which serve as a guide tracks to impede rotation of the lower cable guide relative to the upper cable guide and to the drill pipe.

2. An apparatus to store electrical conductor cable in a drill string between a surface and a subsurface location which comprises:

(a) upper and lower cable guides capable of being positioned in the drill pipe;

(b) a means for mounting the upper cable guide to the drill pipe;

(c) a conductor cable anchored to a subsurface location to establish a transmission line for well drilling telemetry and shaped into three segments (i) a first segment which extends from the subsurface location up to and around the upper cable guide and which is held in tension by means for gripping associated with the upper cable guide, (ii) a second segment which extends from the upper cable guide down to and around the lower cable guide, and (iii) a third segment which extends from the lower cable guide up to the surface;

(d) a flexible, elongated member attached to the drill pipe at the member's ends and tensioned, and (e) a first connector arm which attaches the lower cable guide to the member and a second connector arm which attaches the lower cable guide to the first segment of conductor cable, the first and second connector arms allow axial motion, but impede rotation of the lower cable guide relative to the upper cable guide and to the drill pipe.

3. An apparatus as defined in claim 2 wherein the upper cable guide is releasably mounted in the drill pipe, and the connector arm to the elongated member is releasably attached to the member.

4. An apparatus as defined in claim 3 which further comprises a means for gripping the conductor cable so that tension may be maintained in the first segment of conductor cable.

5. An apparatus as defined in claim 4 wherein the elongated member is a cable.

6. An apparatus as defined in claim 5 wherein the elongated member is releasably attached to the drill pipe.

7. A method to store an electrical conductor in a drill pipe which comprises the steps of:

(a) lowering a connection into the drill pipe on a flexible elongated member;

(b) seating the connection in the drill pipe;

(c) tensioning the member;

(d) fastening the upper end of the member to the drill pipe;

(e) extending the electrical conductor cable from a subsurface location up to and around an upper cable guide, down to and around a lower cable guide, and up to the surface;

(f) mounting the upper cable guide in the drill pipe; and (g) paying out cable from the surface so that the lower cable guide lowers in the drill pipe to store excess conductor cable in an overlapped configuration, the axial motion of the lower cable guide being tracked on the elongated member which serves as a guide track to impede rotation of the lower cable guide relative to the upper cable guide and to the drill pipe.

* * * * *